US005533829A

United States Patent [19]

Campbell

[11] Patent Number: 5,533,829

[45] Date of Patent: Jul. 9, 1996

[54] PAVING MACHINE WITH MIXING DEVICE AND DISCHARGE CONVEYOR ASSEMBLY FOR REMIXING SEGREGATED PAVING MATERIALS

[75] Inventor: Thomas R. Campbell, Chattanooga, Tenn.

[73] Assignee: Astec Industries, Inc., Chattanooga, Tenn.

[21] Appl. No.: 433,863

[22] Filed: May 2, 1995

Related U.S. Application Data

[63] Continuation-in-part of Ser. No. 314,348, Sep. 29, 1994, and Ser. No. 389,257, Feb. 16, 1995.

[51] Int. Cl.[6] ..... E01C 19/18

[52] U.S. Cl. ..... 404/81; 404/108; 404/110

[58] Field of Search ..... 404/75, 101, 108, 404/110, 113, 72, 81

[56] References Cited

U.S. PATENT DOCUMENTS

| | | | |
|---|---|---|---|
| 3,217,620 | 11/1965 | Mindrum et al. | 404/108 X |
| 3,453,939 | 7/1969 | Pollitz et al. . | |
| 3,699,855 | 10/1972 | Leister . | |
| 3,907,451 | 9/1975 | Fisher et al. . | |
| 3,967,912 | 7/1976 | Parker | 404/108 X |
| 4,708,519 | 11/1987 | Davin et al. . | |
| 4,818,139 | 4/1989 | Brock et al. . | |
| 5,035,534 | 7/1991 | Brock et al. | 404/110 X |
| 5,100,277 | 3/1992 | Musil | 404/108 X |
| 5,201,604 | 4/1993 | Ferguson et al. | 404/110 |
| 5,269,626 | 12/1993 | Soliman et al. | 404/108 |

FOREIGN PATENT DOCUMENTS

| | | | |
|---|---|---|---|
| 2224530 | 5/1990 | United Kingdom | 404/108 |

OTHER PUBLICATIONS

Roadtec brochure "Self Propelled Paving Machine", (undated).

*Primary Examiner*—David J. Bagnell
*Assistant Examiner*—James A. Lisehora
*Attorney, Agent, or Firm*—Nilles & Nilles

[57] ABSTRACT

A paving machine is described which includes: a gravity feed hopper located near a front end of a chassis; a distributing auger mounted on the chassis near the rear end thereof and extending transversely across the chassis; a remixing device including a variable-pitch screw auger with i) a first flight section and ii) a second flight section, the second flight section being located transversely between a lower discharge opening of the hopper and the first flight section, the pitch of the first flight section being lower than the pitch of the second flight section so that volumes bounded by flights of the second flight section are greater than volumes bounded by flights of the first flight section, so as to enable finer paving materials, located in a transverse central portion of the hopper to enter void spaces in volumes bounded by flights of the second flight section and combine with coarser paving material, thereby remixing segregated paving materials; and a discharge conveyor assembly extending longitudinally and horizontally from the lower discharge opening to the distributing auger, the discharge conveyor assembly including a pair of parallel drag slat conveyors, each of the pair of parallel drag slat conveyors including a discharge end located directly above the distributing auger for discharging paving materials directly on top of the distributing auger, thereby remixing segregated paving materials. The remixing device and the discharge ends provide significant advantages in that they both remix segregated paving materials.

10 Claims, 7 Drawing Sheets

PAVING MACHINE WITH MIXING DEVICE AND DISCHARGE CONVEYOR ASSEMBLY FOR REMIXING SEGREGATED PAVING MATERIALS

CROSS REFERENCE TO RELATED APPLICATIONS

This application is a continuation-in-part of co-pending and commonly assigned U.S. patent application Ser. No. 08/314,348, filed Sep. 29, 1994, and a continuation-in-part of co-pending and commonly assigned U.S. patent application Ser. No. 08/389,257, filed Feb. 16, 1995, both of which were filed in the name of the inventor named in the present application.

BACKGROUND OF THE INVENTION

1. Field of the Invention

The invention relates to paving machines and, more particularly, relates to a method and apparatus for improving the operation of a machine for paving hot mix asphalt or the like by facilitating hopper loading, improving the feed of materials to the distributing auger, and improving the composition of materials fed to and/or distributed by the distributing auger.

2. Discussion of the Related Art

Paving machines are well known for receiving paving materials such as hot mix asphalt (HMA), distributing the paving materials onto a roadway or another surface, and working the materials into a mat. Such machines typically include a self-propelled tractor-like vehicle having a chassis; an engine mounted on the chassis for propulsion and for material distribution functions; a hopper mounted on the chassis; a helical screw type distributing auger mounted near the rear of the chassis; and a heated vibratory screed mounted on the chassis behind the distributing auger.

The hopper, typically having a capacity of about 12 tons, is relatively low to the ground and extends all the way to the front of the paving machine so as to be capable of receiving HMA directly from a truck positioned in front of and pushed by the paving machine as the paving machine travels along the roadway. Hoppers of this type are incapable of feeding HMA by gravity to the distributing auger mechanism and thus require an internal conveyor mechanism to convey materials from the front of the hopper to a rear discharge opening located adjacent the distributing auger mechanism. This conveyor mechanism typically takes the form of a pair of parallel drag slat conveyors extending longitudinally of the hopper and communicating with independently operable feeder gate mechanisms located at the discharge opening.

In use, HMA is discharged from the hopper in one or more windrows in front of the distributing auger as the chassis travels in a forward direction. The distributor auger then distributes and levels the windrowed HMA, and the screed then compacts the distributed material into a mat.

Three problems arise from discharging materials onto the ground in front of the distributing auger as described above.

First, it is difficult to resume paving from the end of a previously-paved segment. If the distributing auger and screed are placed at the end of the previously-paved segment, the HMA conveyor delivers materials at a location which is spaced from the previously-paved segment. The resulting gap between the materials and the end of the previously-paved segment cannot adequately be filled by the distributing auger, resulting in a rough transition area between paved segments. This drawback can be partially alleviated by positioning the discharge point of the HMA conveyor directly in front of the distributing auger. However, a significant gap and resulting rough area still remain.

Second, HMA materials tend to become segregated by weight and particle size when they are stored in and conveyed out of the hopper. Conventional conveyors pile this partially segregated HMA in front of a distributing auger, which then spreads the materials without significant remixing. Indeed, materials at the bottom of the windrows may not be disturbed by the distributing auger. This spreading without significant remixing may result in a poorer quality paved surface.

Third, it is relatively difficult to maintain a uniform discharge of materials from the hopper using such conveyors, particularly when the hopper is nearly empty during which time less or even no materials are delivered to the discharge opening between the times at which successive flights of the conveyors reach the openings. Substantial hand work is required at the end of the mat to compensate for this deficiency and to deliver to the discharge openings any materials which are inaccessible by the conveyors. The problem of uneven feed of materials from the hopper can be partially alleviated by permitting the speeds of the parallel drag slat conveyors to be independently controlled by the operator(s) as disclosed in U.S. Pat. No. 3,453,939 to Pollitz et al. Such a control system, however, necessarily increases further the cost and complexity of the paving machine and also places additional burdens on the operators.

OBJECTS AND SUMMARY OF THE INVENTION

It is therefore an object of the invention to provide a paving machine capable of delivering substantially all stored materials to a lower discharge opening or at least to a transverse line bisecting the discharge opening.

Another object of the invention is to provide a paving machine which exhibits one or more of the characteristics discussed above which is capable of providing a uniform flow of paving materials to the discharge opening of the hopper at all times and which is easily accessible by a variety of material transfer vehicles and conveyors.

In accordance with a first aspect of the invention, these objects are achieved by providing a paving machine comprising a portable chassis having front and rear ends, a gravity feed hopper, and a distributing auger. The hopper is located near a front end of the chassis and has (1) an upper inlet, (2) front and rear walls, and (3) a floor connecting the front and rear walls to one another and having a lower discharge opening formed therein at a location between the front and rear walls. The distributing auger is mounted on the chassis near the rear end thereof and extends transversely across the chassis.

In order to promote gravity feed, the hopper preferably has an upper inlet and front and rear walls inclined inwardly at lower ends thereof towards the discharge opening. In order to facilitate access by a material transfer device, the hopper preferably has a from wall having an enlarged notch formed in an upper end thereof for receiving the material transfer device.

Another object of the invention is to provide a paving machine which has one or more of the characteristics discussed above and which improves the quality of the mix by discharging paving materials directly on top of the distributing auger.

In accordance with another aspect of the invention, this object is achieved by providing a discharge conveyor assembly extending longitudinally from the hopper to the distributing auger, the discharge conveyor assembly having a discharge end located directly above the distributing auger.

Another object of the invention is to provide a paving machine which has one or more of the characteristics discussed above and which remixes partially segregated materials in a hopper thereof so as to improve the quality of the paved surface.

In accordance with another aspect of the invention, this object is achieved by providing a variable-pitch screw auger with a first flight section and a second flight section located transversely between the discharge opening and the first flight section, the pitch of the first flight section being higher than the pitch of the second flight section.

Still another object of the invention is to provide an improved method of paving HMA or the like.

In accordance with still another aspect of the invention, this object is achieved by first providing a paving machine including a portable chassis having front and rear ends, a gravity feed hopper located near a front end of the chassis, and a distributing auger located near the rear of the chassis. The hopper has (a) an upper inlet, (b) front and rear walls, and (c) a floor connecting the front and rear walls to one another and having a lower discharge opening formed therein at a location between the front and rear walls. Further steps include storing paving materials in the hopper, then feeding the paving materials transversely to the discharge opening while remixing segregated paving materials, the feeding and remixing step comprising rotating a variable pitch auger extending transversely across the hopper, then discharging the paving materials from the discharge opening, and then distributing the paving materials onto a surface to be paved using the distributing auger.

These and other objects, features, and advantages of the invention will become more readily apparent to those skilled in the art from the following derailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

1. Résumé

Figure 1:
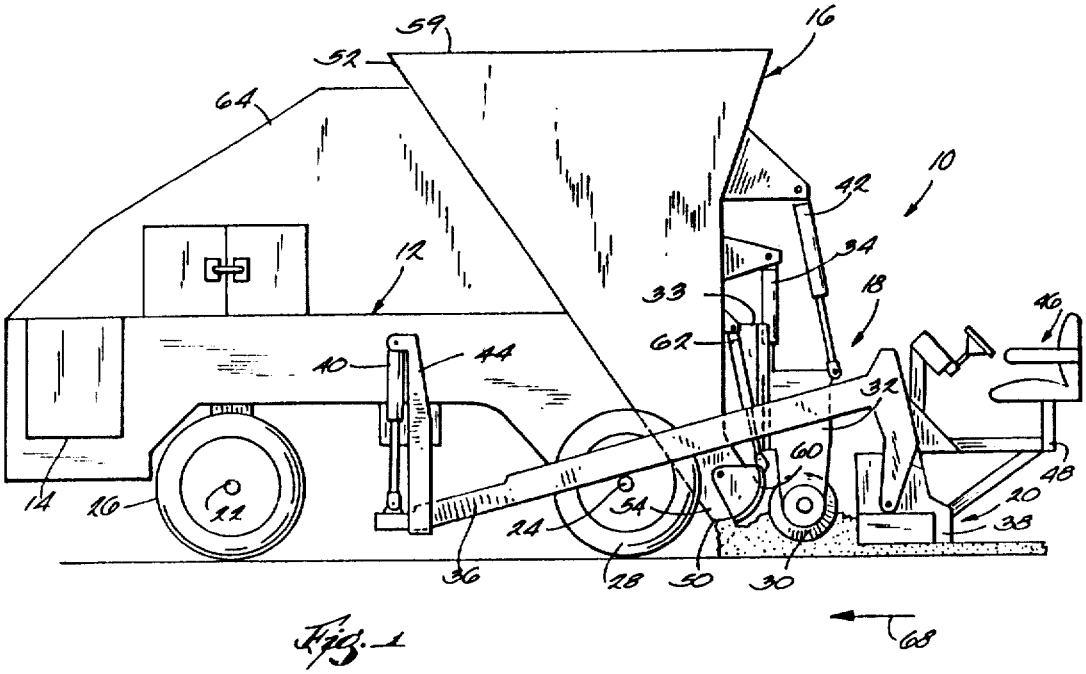
FIG. 1 is a side-elevation view of a paving machine constructed in accordance with a first preferred embodiment of the present invention.
Figure 2:
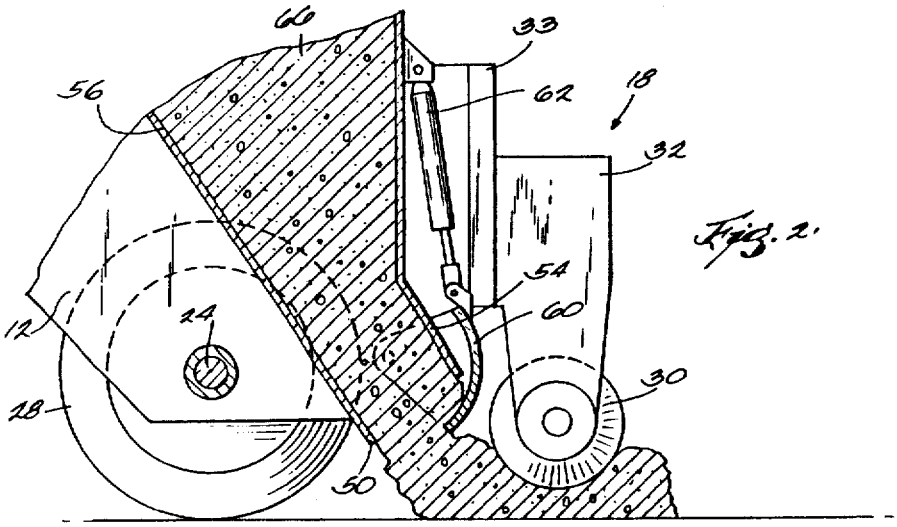
FIG. 2 is a side-sectional elevation view of a portion of the paving machine illustrated in FIG. 1 with the screed assembly removed.
Figure 3:
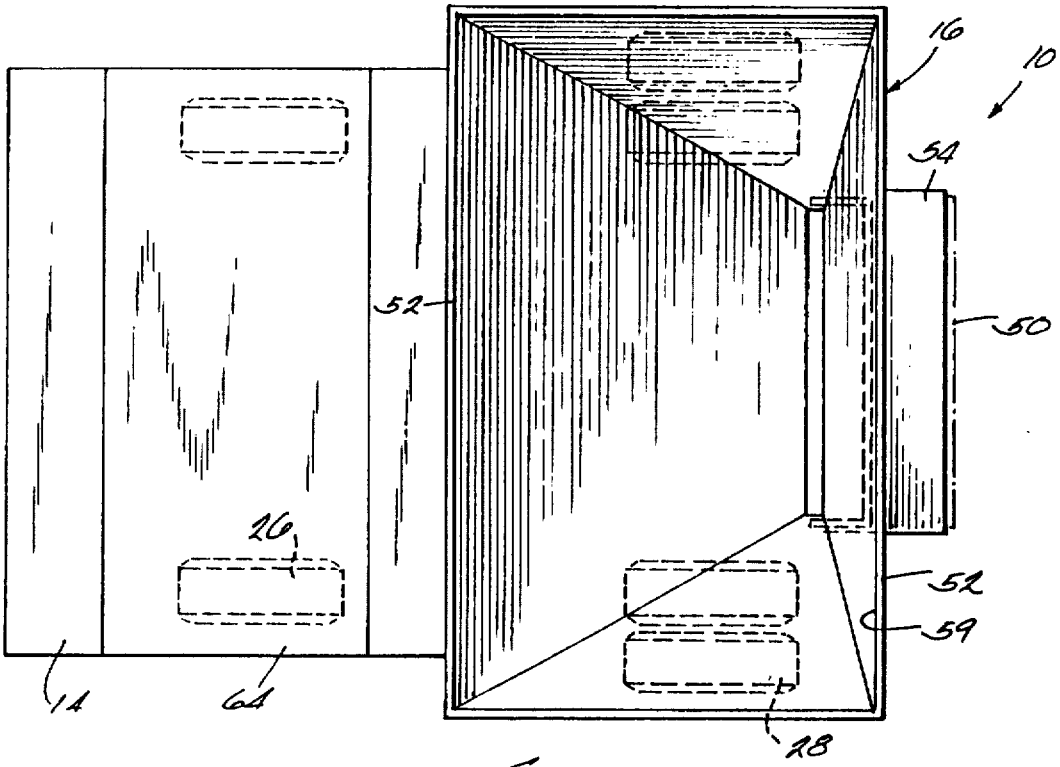
FIG. 3 is a top-plan view of a portion of the paving machine of FIG. 1 with the distributing auger mechanism and the screed assembly removed.

Pursuant to the invention, a paving machine is provided which (1) requires no longitudinal internal conveyor, (2) discharges HMA or other paving materials directly on top of a distributing auger located between the paving material storage hopper and the screed, and/or (3) is capable of remixing any partially segregated paving materials and of uniformly distributing the paving materials directly adjacent a previously-paved segment. The paving machine preferably includes a gravity feed hopper having a discharge opening which discharges materials onto a conveyor which delivers the materials directly onto the distributing auger, thereby remixing segregated materials. A variable pitch auger is preferably provided in the hopper for feeding materials transversely to the opening while remixing segregated materials.

2. Construction and Operation of First Embodiment

Referring now to the drawings, a paving machine 10 constructed in accordance with a first preferred embodiment of the invention is illustrated and includes a self-propelled chassis 12 on which are mounted from front to rear an engine 14; a hopper 16; and a paving apparatus including (1) a distributing auger mechanism 18, and (2) a screed assembly 20. The chassis 12 is mounted on front and rear axles 22 and 24 receiving from steering and rear driving wheels 26 and 28, respectively. The front and rear axles 22 and 24 are steered and powered hydrostatically by engine 14 in a known manner.

Screed assembly 20 and distributing auger mechanism 18 may be any conventional mechanisms and, in the illustrated embodiment, are of the type employed by the paving machine manufactured by Roadtec of Chattanooga, Tenn. under the Model No. RP-180. The distributing auger mechanism 18 thus includes a hydrostatically driven screw-type distributing auger 30 extending transversely across the chassis 12 and mounted on a slide 32 which is raiseable and lowerable with respect to a stationary frame 33 via operation of hydraulic cylinders 34. The screed assembly 20 comprises 1) a pair of transversely opposed tow arms 36 (only one of which is illustrated), and 2) a heated vibratory screed 38 pivotably suspended from the rear ends of the tow arms 36. Each tow arm 36 is raiseable and lowerable with respect to the chassis 12 at its front end via a first hydraulic cylinder 40 and at its rear end via a second hydraulic cylinder 42. The front end of each of the tow arms 36 is also pivotally connected to the chassis 12 at a tow point, formed from a suspended bracket assembly 44, so as to permit vertical adjustment of the screed assembly 20 using the cylinders 40 and/or 42.

It should be noted that, in typical paving machines heretofore available, the paving material feed and delivery devices (including the discharge conveyors and distributing auger mechanism) and screed were controlled by separate operators positioned on the paving machine chassis and screed, respectively. It is also not unusual in such machines to have dual stations on the paving machine to permit the machine to be operated from either lateral side with the active operator station being determined by the instantaneous operating conditions of the machine. However, because the paving machine 10 is considerably simplified compared to typical paving machines, it is possible to perform all manual control operations required to run both the entire machine 10 including the screed assembly 20 from a single operator's station or console 46 mounted on a support platform 48 which is in turn mounted on the screed 38. Although the operator's station or console 46 is illustrated as being fixed in position, this station could if desired be mounted on a carriage which is movable transversely across the platform 48 thereby permitting the operator to run the machine 10 from either side of the screed assembly 20 without requiring the dual consoles employed by many paving machines which were heretofore available. Console 46 can also be installed on the rear of the hopper 16 in lieu of the screed 38.

The hopper 16 preferably has a total capacity of about 12 tons to conform with industry standards and is designed to feed by gravity to a discharge opening 50 thereof all of the paving materials stored therein without employing any internal conveyors. To this end, the hopper 16 includes an upper storage portion 52 and a lower discharge portion or discharge chute 54. The storage portion 52 has at least a lower generally frusto-conical section 56 having an upper end of enlarged cross section and having a lower end of reduced cross section connected to an upper end of the discharge chute 54. (The term "frusto-conical" as used herein is not meant to require a square cone but instead denotes any structure the cross section of which decreases substantially continuously from an upper end to a lower end thereof). An upper section 58 of storage portion 52 is preferably provided above the lower section 56 to increase the capacity of the hopper 16 and, in the illustrated embodiment, is of a relatively constant width and terminates at an open top 59. Discharge chute 54 has the discharge opening 50 formed in the bottom end thereof and in use directs paving materials from the storage portion 52 to the discharge opening 50. The discharge chute 54 is also inclined downwardly and rearwardly towards the distributing auger mechanism 18 so as to direct paving materials towards the top of the auger mechanism 18 without the aid of any external conveyors. The transverse length of the discharge opening 50 is preferably roughly the same as the length of the distributing basic auger mechanism 18 so as to promote uniform material feed to all portions of the auger mechanism 18.

The discharge opening 50 in the hopper 16 is selectively closeable by a feeder gate 60 which, in the illustrated embodiment, takes the form of a clam shell gate opened and closed by a drive device 62. The drive device 62 may comprise a screw jack or the like but preferably comprises at least one and even more preferably a pair of hydraulic cylinders suspended from the outer wall of the storage portion 52 and connected to respective end portions of the gate 60.

The hopper 16 is preferably located at the rear of the paving machine 10 to obviate the need for any conveyors to deliver materials to the distributing auger 30 after they are discharged from the hopper. The thus located hopper 16 may however, when fully loaded, tend to overload the back end of the paving machine 10 so as to destabilize the machine 10. This potential problem is overcome by locating the engine 14 and the heavy frame steel components near the front of the chassis 12 and preferably in front of the front axle 22 as illustrated, thereby providing sufficient weight at the front of the machine 10 to counteract any destabilizing effect caused by mounting the hopper 16 at the rear of the machine 10. This construction results in a substantial space between the engine 14 and the hopper 16 which may be left open or may be enclosed as illustrated to form a storage compartment 64 or the like.

In use, the paving machine 10 is readied for operation by positioning it on the roadway surface to be paved and by filling the hopper 16 with paving materials 66. The paving materials 66 could be any of various known materials but will usually comprise HMA and will henceforth be referred to as HMA for the sake of convenience. The hopper 16 is filled by conveying HMA 66 through the open top 59 using either a separate conveyor or a shuttling apparatus such as that disclosed in U.S. Pat. No. 4,818,139 to Brock et al. (such an apparatus is required because the hopper 16 is too high to be accessed directly by a dump truck). The sloping side of hopper 16 is preferably heated at this time by engine exhaust or another suitable heat source in order to maintain good flow of HMA to the screed.

The operator, seated at station or console 46, then controls the engine 14 to propel the paving machine 10 in the direction of the arrow 68 in FIG. 1. Paving is commenced by discharging HMA from the discharge opening 50 of the hopper 16 on top of the distributing auger 30, which then remixes and distributes the HMA. The HMA is then worked into a mat using the screed assembly 20. HMA continues to flow by gravity out of the hopper 16 at a substantially uniform rate (assuming a constant operational state of the feeder gate 60) until the hopper 16 is completely or nearly completely empty. The need for independent controls of internal conveyors to promote a uniform HMA feed is eliminated because the hopper 16 delivers HMA uniformly even when the hopper 16 is nearly empty. Less manual labor is required at the end of the mat due to this superior material flow control than is required by hoppers which employ internal drag slat conveyors.

The rate of HMA delivery from the hopper 16 can be adjusted as required to accommodate changes in vehicle speed and/or in auger and/or screed operation simply by actuating the cylinders 62 to change the position of the feeder gate 60, thus varying the effective cross section of the discharge opening 50. Operation of the cylinders 62 could be controlled manually based on visual observation of at least one of (1) machine speed and (2) the operating conditions of the screed assembly 20 and/or distributing auger mechanism 18 or, in a more sophisticated embodiment, could be controlled automatically based upon sensed operating parameters. The control of HMA discharge using a single feeder gate 60 considerably simplifies paving machine operation and contributes to the ability to control the entire paving machine 10 using a single operator stationed at console 46.

Discharging HMA toward or onto the top of the distributing auger 30 as described above rather than on the ground in front of the distributing auger has at least two advantages. First, when the paving machine 10 is resuming paving from the end of a previously-paved segment, materials are discharged closely adjacent the end of the previously-paved pavement, thus permitting the distributing auger 30 to evenly distribute materials at this location and hence permitting the formation of a more uniform mat by the screed assembly 20 with a less noticeable seam between the paved segments. Second, any material segregation which occurs when materials are stored in or discharged from the hopper 16 is alleviated by the remixing of the materials by the distributing auger 30. The remixing is significantly enhanced compared to prior art devices because all or nearly all of the materials discharged from the hopper 16 are spread by the distributing auger 30. By contrast, distributing augers of prior art pavers contact only the upper portions of windrowed paving materials, leaving the lower portions undisturbed.

3. Construction and Operation of Modified Form of First Embodiment

Figure 4:
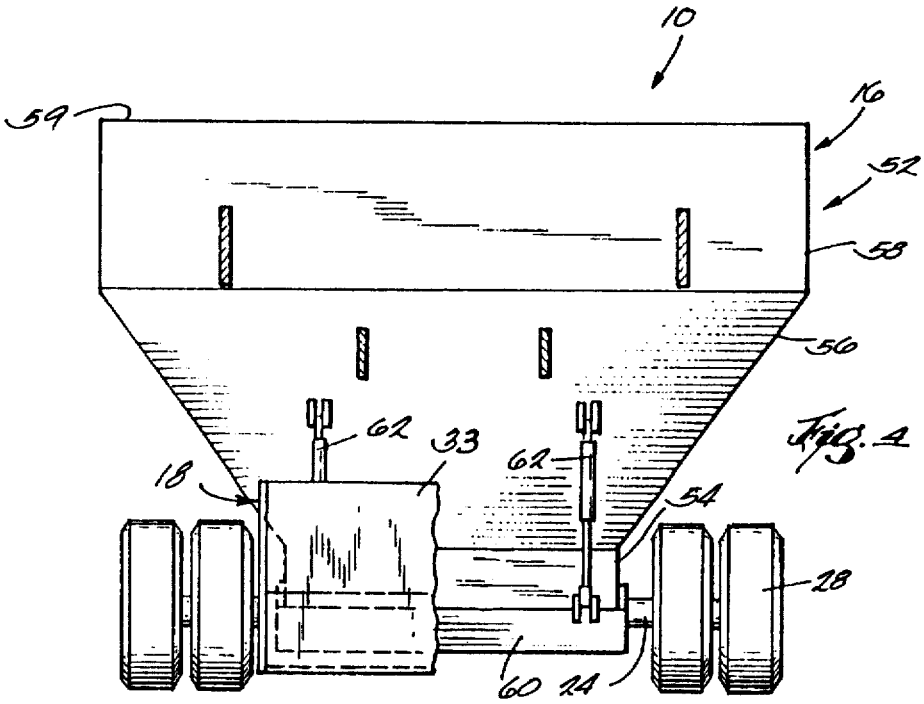
FIG. 4 is a partially cut-away rear elevation view of a portion of the paving machine of FIGS. 1–3 with the distributing auger mechanism and screed assembly removed.
Figure 5:
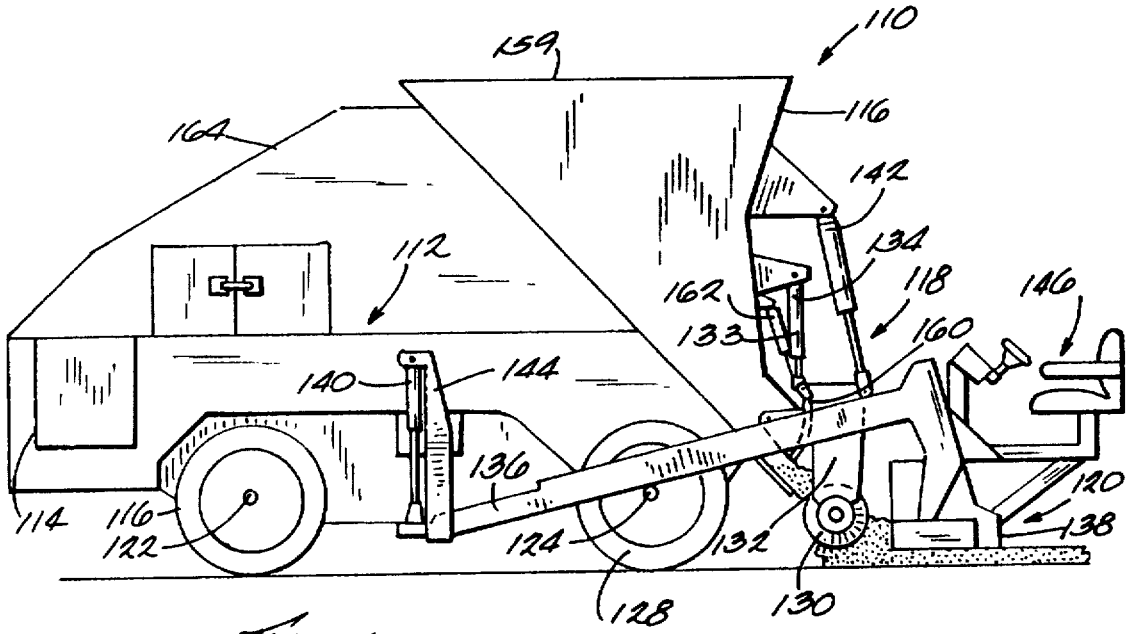
FIG. 5 is a side-elevation view of a modified form of the paving machine of FIGS. 1–4.
Figure 6:
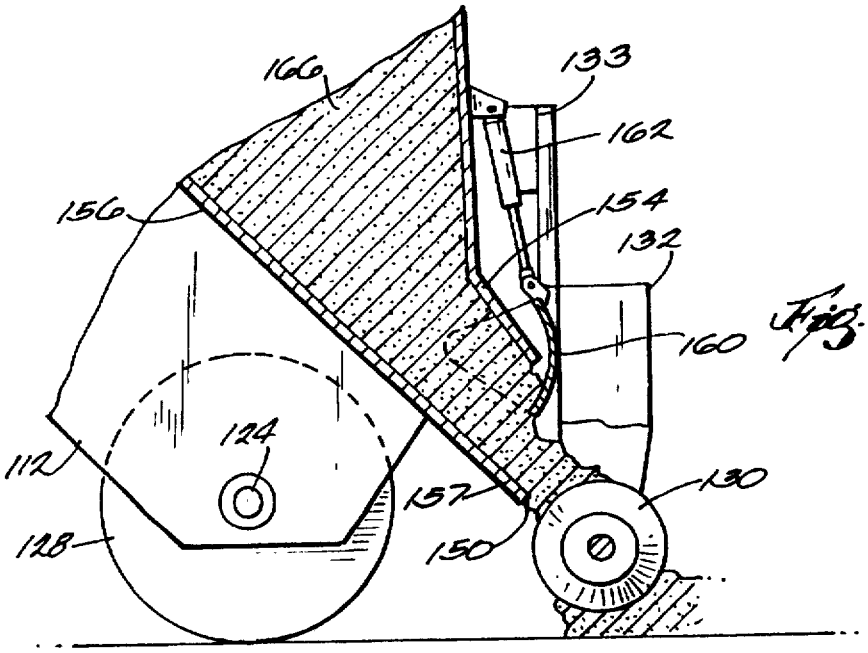
FIG. 6 is a side-sectional elevation view of a portion of the paving machine of FIG. 5.

The paving machine 10 illustrated in FIGS. 1–4 is capable of discharging all materials towards the top of the distributing auger 30 but, because of the illustrated relationship between the hopper discharge opening 50 and the distributing auger 30, may not be capable of adequately discharging materials directly on top of the distributing auger 30. An arrangement better suited for this purpose is illustrated in FIGS. 5 and 6 which is identical in construction and operation to the paving machine 10 of FIGS. 1–4 except for the locations of the hopper 116 and discharge opening 150 relative to the distributing auger 130. Elements of the modified paving machine 110 of FIGS. 5 and 6 corresponding to those of the paving machine 10 of FIGS. 1 and 4 are designated by the same reference numerals, incremented by 100.

The paving machine 110 of FIGS. 5 and 6 differs from the paving machine 10 of FIGS. 1–4 only in that the hopper 116 and discharge opening 150 are located slightly behind and above the locations of the corresponding hopper 16 and discharge opening 50 of the machine 10 of FIGS. 1–4. This arrangement assures that the discharge opening 150 is located directly above the distributing auger 130. "Directly above" as used herein does not mean that all or even any of the discharge opening 150 be located in the same vertical plane as the distributing auger 130. Rather, "directly above" means that the discharge opening 150 is located above the distributing auger 130 and sufficiently close to the distributing auger 130 that materials discharged from the opening 150 fall onto the upper portions of the distributing auger 130 as opposed to the ground. Shifting the discharge opening 150 in this manner can if desired can be facilitated by extending the front wall 157 of the hopper 116 beyond the gate 160 as illustrated. The resulting construction assures remixing of paving materials and a uniform boundary between paved segments as discussed above.

4. Construction and Operation of Second Embodiment

Figure 7:
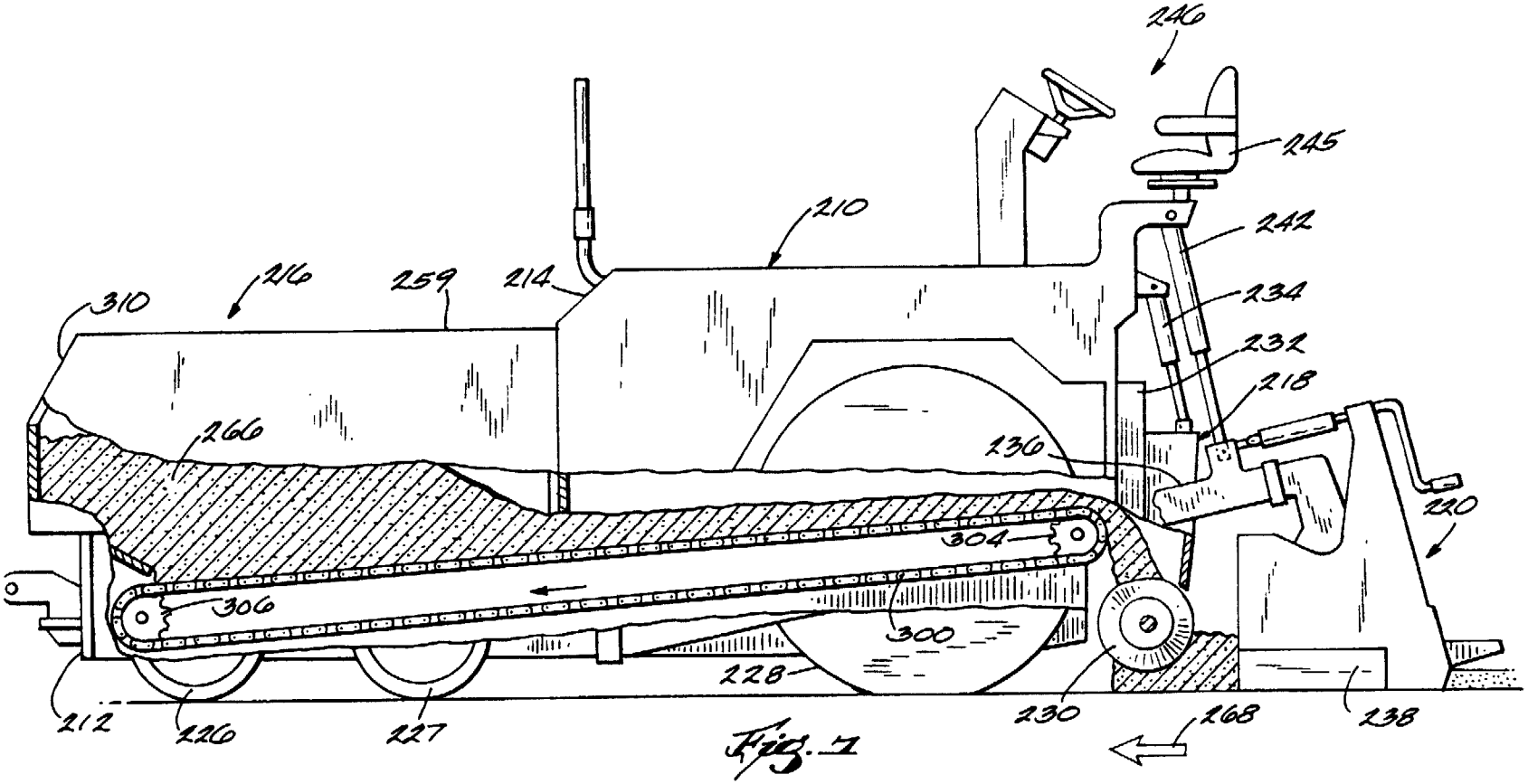
FIG. 7 is a partially cut away side-elevation view of a paving machine constructed in accordance with a second embodiment of the invention.
Figure 8:
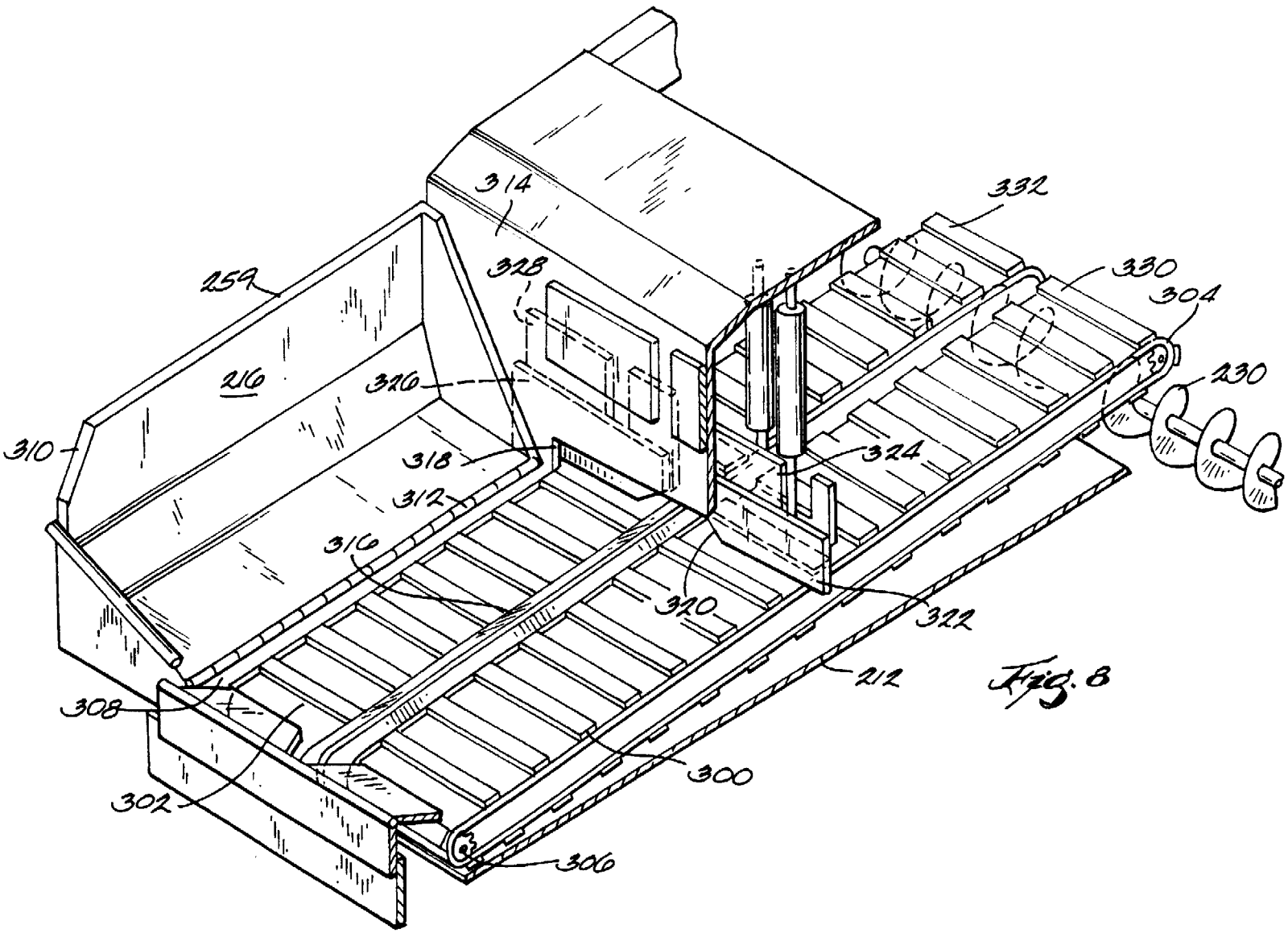
FIG. 8 is a perspective view of portions of the hopper, material discharge conveyor, and distributing auger mechanism of the paving machine of FIG. 7.

The concept of discharging materials on top of a distributing auger rather than in front of it can also be applied to more conventional paving machines having a storage hopper located on the front end portion of the chassis. One such paving machine 210 is illustrated in FIGS. 7 and 8 in which elements corresponding to elements of the paving machine 10 of FIGS. 1–4 are designated by the same reference numerals, incremented by 200.

Paving machine 210 includes a self-propelled chassis 212 on which are mounted from front to rear a hopper 216; an engine 214; and a paving apparatus including (1) a distributing auger mechanism 218 and (2) a screed assembly 220. A pair of drag slat discharge conveyors 300, 302 convey materials from the hopper 216 to the distributing auger mechanism 218. The chassis 212 is mounted on front, intermediate, and rear wheels 226, 227, and 228, respectively. The axles supporting the smaller front wheels 226 and the enlarged rear wheels 228 are steered and powered hydrostatically by engine 214 in a known manner.

Screed assembly 220 and distributing auger mechanism 218 may be any conventional mechanisms and, in the illustrated embodiment, are of the type employed by the paving machine manufactured by Roadtec of Chattanooga, Tenn. under the Model No. RP-80. The distributing auger mechanism 218 thus includes a hydrostatically driven helical screw-type distributing auger 230 extending transversely across the chassis 212 and mounted on a slide 232 which is raised and lowered with respect to the chassis 212 via operation of hydraulic cylinders 234 (only one of which is illustrated). The screed assembly 220 comprises (1) a pair of transversely opposed tow arms 236 (only one of which is illustrated), and (2) a heated vibratory screed 238 pivotally suspended from the rear ends of the tow arms 236. Each tow arm 236 is raiseable and lowerable with respect to the chassis 212 at its front end via a first hydraulic cylinder (not shown) and at its rear end via a second hydraulic cylinder 242. The front end of each of the tow arms 236 is also pivotally connected to the chassis 212 at a tow point in the conventional manner. Portions of the paving machine 210, including at least the distributing auger mechanism 218 and discharge conveyors 300, 302, are controlled by an operator seated on a seat 245 and stationed at a console 246. If necessary, a second operator station (not shown) may be positioned on the screed assembly 220.

The hopper 216 preferably has a total capacity of about 12 tons to conform with industry standards and is designed to receive paving materials from a dump truck and to deliver them to the discharge conveyors 300, 302. The hopper 216 has a floor 308, pivotable side wings 310 mounted to the floor 308 by hinges 312, and a rear wall 314. The conveyors 300, 302 are driven by a conventional hydrostatically-driven drive sprocket 304 and are guided by one or more conventional guide sprockets 306. A shield 316 extends between the conveyors 300, 302 to direct paving materials onto the flights of the conveyors 300, 302. Shield 316 also bisects an aperture formed in the rear end wall 314 of the hopper 216 to define first and second discharge openings 318, 320. The discharge openings 318, 320 are selectively opened and closed by feeder control gates 322, 324; 326, 328 which are independently raised and lowered by cylinders (only two of which, 330 and 332, are illustrated) or by electric screw jacks or other suitable mechanisms. The control gates 322, 324; 336, 338 can also be positioned by the cylinders 330, 332 to control the discharge rate of materials from the hopper 216 in a manner which is, per se, known.

Pursuant to the invention, the conveyors 300, 302 are designed to discharge materials on top of the distributing auger 230 rather than in front of the distributing auger as is standard in the art. This function could be achieved by employing standard conveyors terminating in front of the distributing auger 230 in combination with inclined conveyors which convey materials from the existing conveyors onto the distributing auger 230. It is preferred, however, that materials be conveyed from the hopper 216 directly to the distributing auger 230 to simplify the machine. To this end, each of the conveyors 300, 302 extends longitudinally through the length of the hopper 216, through the respective discharge opening 318 and 320 in the rear wall of the hopper 216, and terminate in a discharge end 330, 332.

The discharge ends 330, 332 of the conveyors 300, 302, like the discharge opening 150 of the hopper 116 of FIGS.

5 and 6, form a discharge device discharging paving materials directly on top of the distributing auger 230. The discharge ends 330, 332 are thus located "directly above" the distributing auger 230 as this term is used above. Because the floor of the typical hopper is located near or below the top of the distributing auger 230, the conveyors 300, 302 must be inclined upwardly from the front to rear ends thereof to discharge materials from the desired point above the distributing auger 230. The discharge ends 330, 332 typically will be located about 6" to 10" above the top of the distributing auger 230 and will be raised 8" to 12" with respect to the front ends of the conveyors 300, 302. If necessary, the wings 310 and floor 308 of the hopper 216 may be sloped accordingly.

In use, to ready the paving machine 210 for use, the hopper 216 is filled through the open top 259 in the conventional manner using a dump truck or the like. The operator, seated at station or console 246, then controls the engine 214 to propel paving machine 210 in the direction of the arrow 268 in FIG. 7. The control gates 322, 324; 326, 328 are opened and the conveyors 300, 302 activated at or just before this time to begin the delivery of HMA 266 onto the distributing auger 230 as the machine 210 begins to move. Paving is then commenced by discharging HMA 266 from the conveyors 300, 302 directly on top of the distributing auger 230, which is then capable of remixing any segregated materials and distributing the HMA 266 immediately adjacent a previously paved road segment in the same manner as the distributing auger mechanisms 18 and 118 of the pavers 10 and 110 discussed above. The rate of HMA delivery to the distributing auger 230 can be adjusted at this time by controlling the speed of the conveyors 300, 302 and/or the position of the gates 322, 324; 326, 328 to accommodate changes in vehicle speed and/or auger and/or screed operation.

5. Construction and Operation of Third Embodiment

Figure 9:
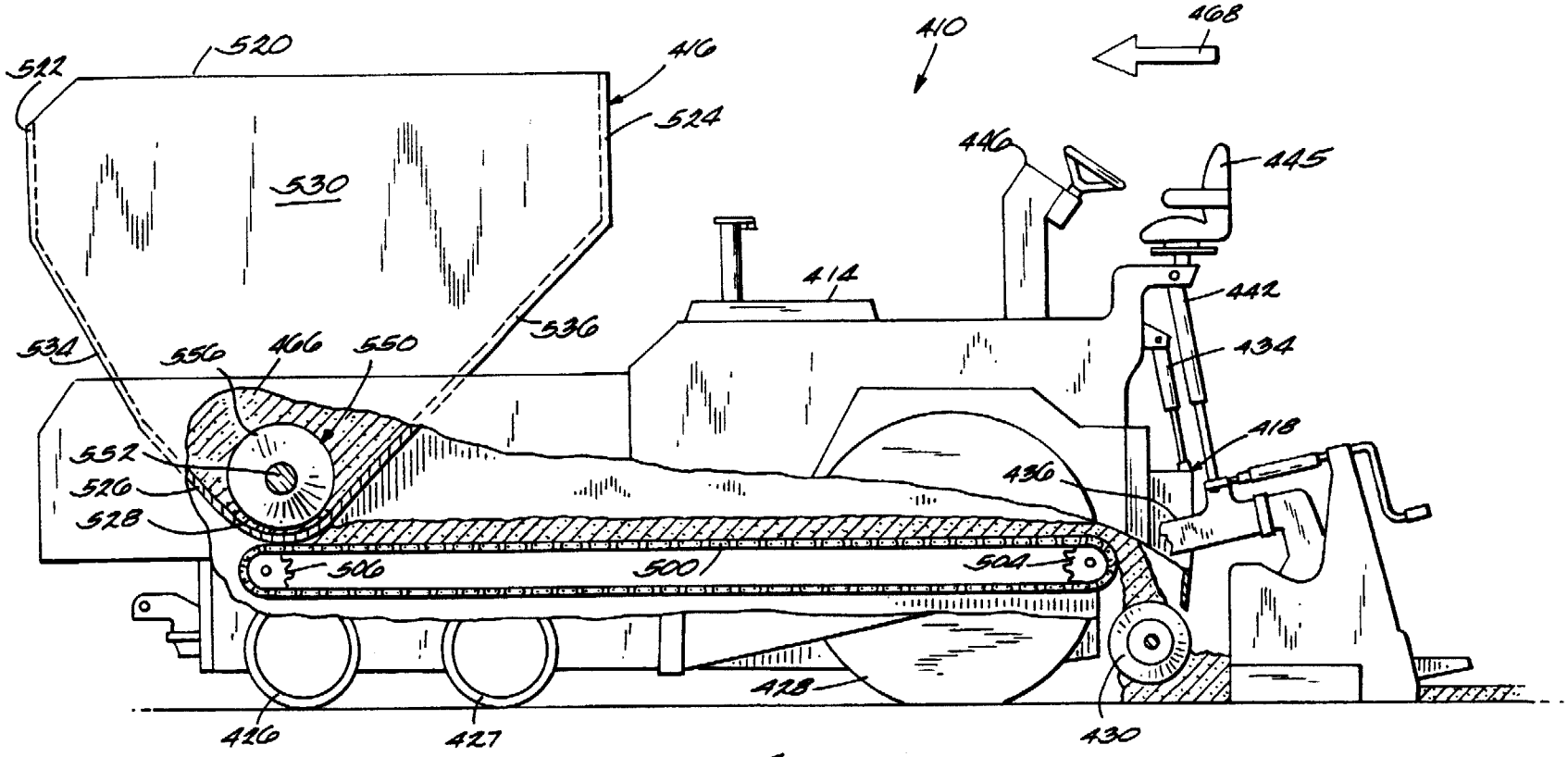
FIG. 9 is a partially cut away side-elevation view of a paving machine constructed in accordance with a third embodiment of the invention.
Figure 10:
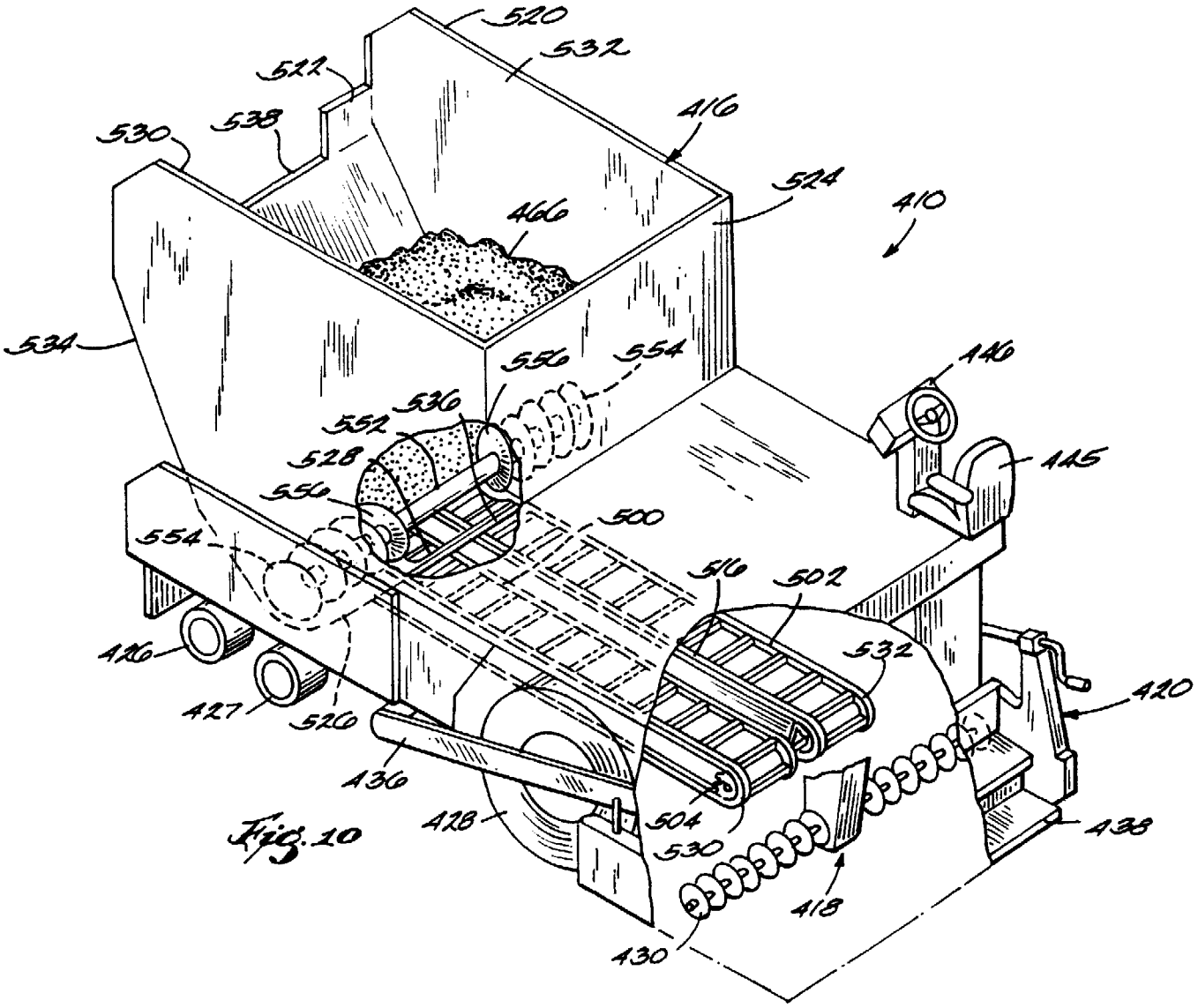
FIG. 10 is a perspective view of portions of the hopper, material discharge conveyor, and distributing auger mechanism of the paving machine of FIG. 9.

At least some of the advantages of the devices of the first and second embodiments can, if desired, be combined by placing a gravity feed hopper near the front of the paving machine and/or by providing a structure within the hopper for remixing segregated aggregate. One such paving machine 410 is illustrated in FIGS. 9 and 10 in which elements corresponding to elements of the paving machine 210 of FIGS. 7–8 are designated by the same reference numerals, incremented by 200.

Paving machine 410 includes a self-propelled chassis 412 on which are mounted from front to rear a hopper 416; an engine 414; and a paving apparatus including (1) a distributing auger mechanism 418 and (2) a screed assembly 420. Although not required, a discharge conveyor assembly such as a pair of drag slat discharge conveyors 500, 502 preferably convey materials from the hopper 416 to the distributing auger mechanism 418 for reasons detailed below. The chassis 412 is mounted on front, intermediate, and rear wheels 426, 427, and 428, respectively. The axles supporting the smaller front wheels 426 and the enlarged rear wheels 428 are steered and powered hydrostatically by the engine 414 in a known manner.

Screed assembly 420 and distributing auger mechanism 418 may be any conventional mechanisms and, in the illustrated embodiment, are of the type described above in connection with the first and second embodiments. The distributing auger mechanism 418 thus includes a hydrostatically driven helical screw-type distributing auger 430 extending transversely across the chassis 412 and mounted on a slide 432 which is raised and lowered with respect to the chassis 412 via operation of hydraulic cylinders 434 (only one of which is illustrated). The screed assembly 420 comprises (1) a pair of transversely opposed tow arms 436 (only one of which is illustrated), and (2) a heated vibratory screed 438 pivotally suspended from the rear ends of the tow arms 436. Each tow arm 436 is raiseable and lowerable with respect to the chassis 412 at its from end via a first hydraulic cylinder (not shown) and at its rear end via a second hydraulic cylinder 442. The from end of each of the tow arms 436 is also pivotally connected to the chassis 412 at a tow point in the conventional manner. Portions of the paving machine 410, including at least the distributing auger mechanism 418, discharge conveyors 500, 502, and a remixing device 550 detailed below, are controlled by an operator seated on a seat 445 and stationed at a console 446. If necessary, a second operator station (not shown) may be positioned on the screed assembly 420.

Hopper 416, like the hoppers 16 and 216 of the first and second embodiments, preferably has a total capacity of about 12 tons to conform with industry standards and is designed to convey at least most of the materials by gravity towards a lower discharge opening. However, unlike the hopper 216 of the second embodiment, hopper 416 is designed to feed at least most of its contents by gravity to a transverse line bisecting a discharge opening 528. Moreover, unlike the hopper 16 of the first embodiment, the hopper 416 is located near the front of the machine 410 so as to be more easily accessible to HMA transfer equipment such as a relatively short conveyor or the material transfer vehicle disclosed and claimed in co-pending and commonly assigned U.S. patent application Ser. No. 314,349, filed Sep. 29, 1994 (the '349 application), the subject matter of which is hereby incorporated by reference. The shuttling apparatus disclosed in U.S. Pat. No. 4,818,139 and discussed above could also be used for this purpose. Hopper 416 also preferably, but not necessarily, includes an internal remixing device 550 detailed below.

Hopper 416 has an upper inlet 520, front and rear walls 522, 524, a floor 526 connecting the front and rear walls to one another, a lower discharge opening 528 formed in the floor 526 at a location between the front and rear walls 522, 524, and side walls 530, 532. The front and rear walls 522 and 524 are inclined inwardly towards the discharge opening 528 at lower ends 534, 536 thereof to channel materials towards a transverse line bisecting the discharge opening 528. An enlarged notch 538 is cut out of the upper end of the front wall 522 to facilitate access by a material delivery apparatus such as that disclosed in the '349 application. The floor 526 is concave to receive the remixing device 550 and has the discharge opening 528 formed in the longitudinal center thereof. The discharge opening 528 could extend the entire transverse width of the hopper 416 but preferably extends less than ½ the transverse width to accommodate the remixing device 550. The side walls 530, 532 extend vertically from the bottom of the floor 526 to the inlet 520.

The remixing device 550 is designed to remix materials which become segregated when they are poured into and/or stored in the hopper 416. The preferred remixing device remixes while conveying materials transversely from the side walls 530, 532 towards the discharge opening 528. In the illustrated embodiment, the remixing device takes the form of a variable pitch screw auger having a shaft 552 extending the transverse length of the hopper 416 and having first and second joining flight sections 554 and 556 located transversely between the discharge opening 528 and the side walls. The pitch of the second flight section 556 is higher than the pitch of the first flight section 554 so that the volumes bounded by the flights of the second section 556 are greater than the volumes bounded by the flights of the first section 554. As a result, when coarse materials, located adjacent the side wall 530 or 532, are conveyed from the first flight section 554 to the second flight section 556, they will not fill the larger volumes, enabling finer materials, located in the transverse central portion of the hopper 416, to enter the void spaces in these larger volumes and combine with the coarser material. This mixture of coarse and fine materials is then discharged from the discharge opening 528.

The conveyors 500, 502 are driven by a conventional hydrostatically-driven drive sprocket 504 and are guided by one or more conventional guide sprockets 506. A shield 516 extends between the conveyors 500, 502 to direct paving materials onto the flights of the conveyors 500, 502 from discharge opening 528. The conveyors 500, 502, like those of the second embodiment, are designed to discharge materials on top of the distributing auger 430. To this end, each of the conveyors 500, 502 extends horizontally from the hopper 416 to terminate in a discharge end 530, 532 discharging paving materials directly on top of the distributing auger 430. The discharge ends 530, 532 are thus located "directly above" the distributing auger 430 as this term is used above. Of course, if the discharge opening 528 of the hopper 416 were located below the level of the distributing auger 430, the conveyors 500, 502 would be inclined as in the second embodiment.

In use, to ready the paving machine 410 for use, the hopper 416 is filled with HMA 466 through the upper inlet 520, preferably using a shuttling apparatus or a material transfer vehicle as discussed above. The material transfer vehicle is especially preferred because it remixes previously segregated HMA particles as described in the '349 application. Access to the hopper 416 by either device is facilitated by the notch 538 in the front wall 522.

The operator, seated at station or console 446, then controls the engine 414 to propel paving machine 410 in the direction of the arrow 468 in FIG. 9. The remixing device 550 is activated to remix segregated materials in the hopper 416 and to feed the remixed materials to the conveyors 500, 502 through the discharge opening 528. The conveyors 500, 502 are then activated to deliver HMA 466 directly on top of the distributing auger 430, which is then capable of remixing any segregated materials and distributing the HMA 466 immediately adjacent a previously paved road segment, where it is worked into a mat by screed 438. The rate of HMA delivery to the distributing auger 430 can be adjusted at this time by controlling the speed of the conveyors 500, 502 and/or the speed of auger or remixing device 550.

Many changes and modifications may be made to the present invention without departing from the spirit thereof. For instance, hoppers, distributing auger mechanisms, and screed assemblies different from those illustrated could be employed. Materials other than HMA could also be distributed and paved using the present invention. The scope of these and other changes will become apparent from the appended claims.

I claim:

1. A paving machine comprising:

A. a portable chassis having front and rear ends;

B. a gravity feed hopper located near the front end of said chassis, said gravity feed hopper having (1) an upper inlet, (2) front and rear walls, (3) side walls, (4) a transverse central portion and (5) a floor connecting said front and rear walls to one another and having a lower discharge opening formed therein at a location between said front and rear walls;

C. a distributing auger mounted on said chassis near said rear end thereof and extending transversely across said chassis, for remixing segregated paving materials and distributing paving materials immediately adjacent a previously paved road segment;

D. a remixing device which conveys paving materials transversely from said side walls toward said lower discharge opening while remixing said materials, said remixing device including a variable-pitch screw auger with i) a first flight section and ii) a second flight section, said second flight section being located transversely between said lower discharge opening and said first flight section, the pitch of said first flight section being lower than the pitch of said second flight section so that volumes bounded by flights of said second flight section are greater than volumes bounded by flights of said first flight section, so as to enable finer paving materials, located in said transverse central portion to enter void spaces in volumes bounded by flights of said second flight section and combine with coarser paving material, thereby remixing segregated paving materials; and E. a discharge conveyor assembly extending longitudinally and horizontally from said lower discharge opening of said gravity feed hopper to said distributing auger, said discharge conveyor assembly including a pair of parallel drag slat conveyors, each of said pair of parallel drag slat conveyors including a discharge end located directly above said distributing auger for discharging paving materials directly on top of said distributing auger, thereby remixing segregated paving materials.

2. A paving machine as defined in claim 1, wherein said front and rear walls are inclined inwardly at lower ends thereof towards said discharge opening.

3. A paving machine as defined in claim 1, wherein said discharge opening of said gravity feed hopper extends less than ½ the transverse length of said gravity feed hopper.

4. A paving machine as defined in claim 1, wherein said front wall of said gravity feed hopper has an enlarged notch formed in an upper end thereof for receiving a material transfer device.

5. A paving machine comprising:

A. a portable chassis having front and rear ends;

B. a gravity feed hopper located near the front end of said chassis, said gravity feed hopper having (1) an upper inlet, (2) front and rear walls, (3) side walls, (4) a transverse central portion and (5) a concave floor connecting said front and rear walls to one another and having a lower discharge opening formed therein, each of said front and rear walls having a lower portion inclined towards said discharge opening;

C. a variable-pitch screw auger which extends transversely across said gravity feed hopper and which conveys paving materials transversely from said side walls toward said lower discharge opening, said variable-pitch screw auger having i) a first flight section and ii) a second flight section, said second flight section being located transversely between said discharge opening and said first flight section, the pitch of said first flight section being lower than the pitch of said second flight section so that volumes bounded by flights of said second flight section are greater than volumes bounded by flights of said first flight section, so as to enable finer paving materials, located in said transverse central portion to enter void spaces in volumes bounded by flights of said second flight section and combine with coarser paving material, thereby remixing segregated paving materials;

D. a distributing auger, mounted on said chassis near said rear end thereof and extending transversely across said chassis, for remixing segregated paving materials and distributing paving materials immediately adjacent a previously paved road segment; and E. first and second parallel drag slat conveyors extending longitudinally and horizontally from said lower discharge opening of said gravity feed hopper to said distributing auger, each of said first and second parallel drag slat conveyors having a discharge end located directly above said distributing auger for discharging paving materials directly on top of said distributing auger, thereby remixing segregated paving materials, wherein said discharge opening extends less than ½ the transverse length of said gravity feed hopper and said front wall of said gravity feed hopper has an enlarged notch formed in an upper end thereof for receiving a material transfer device.

6. A method comprising:

A. providing a paving machine with 1. a portable chassis having front and rear ends;
2. a gravity feed hopper located near the front end of said chassis, said gravity feed hopper having (a) an upper inlet, (b) front and rear walls, (c) side walls, (d) a transverse central portion and (e) a floor connecting said front and rear walls to one another and having a lower discharge opening formed therein at a location between said front and rear walls;
3. a variable-pitch screw auger which extends transversely across said gravity feed hopper and which conveys paving materials transversely from said side walls toward said lower discharge opening, said variable-pitch screw auger having i) a first flight section and ii) a second flight section, said second flight section being located transversely between said lower discharge opening and said first flight section, the pitch of said first flight section being lower than the pitch of said second flight section so that volumes bounded by flights of said second flight section are greater than volumes bounded by flights of said first flight section, so as to enable finer paving materials, located in said transverse central portion to enter void spaces in volumes bounded by flights of said second flight section and combine with coarser paving material, thereby remixing segregated paving materials;
4. a distributing auger, mounted on said chassis near said rear end thereof and extending transversely across said chassis, for remixing segregated paving materials and distributing paving materials immediately adjacent a previously paved road segment; and
5. a discharge conveyor assembly extending longitudinally and horizontally from said lower discharge opening of said gravity feed hopper to said distributing auger, said discharge conveyor assembly including a pair of parallel drag slat conveyors, each of said pair of parallel drag slat conveyors including a discharge end located directly above said distributing auger for discharging paving materials directly on top of said distributing auger, thereby remixing segregated paving materials;

B. storing paving materials in said gravity feed hopper;

C. feeding said paving materials transversely to said lower discharge opening while remixing segregated paving materials, said feeding and remixing including rotating said variable-pitch screw auger so as to remix segregated paving materials;

D. discharging said paving materials from said lower discharge opening to said discharge conveyor assembly;

E. conveying said paving materials along said pair of parallel drag slat conveyors until said paving materials reach the discharge ends of said pair of parallel drag slat conveyors;

F. discharging said paving materials from said discharge ends of said drag slat conveyors directly on top of said distributing auger so as to remix segregated paving materials; and G. distributing said paving materials onto a surface to be paved using said distributing auger.

7. A method as defined in claim 6, wherein said distributing auger is positioned closely adjacent to an end of a previously-paved surface segment, and further comprising propelling said chassis forwardly away from said previously-paved segment during said discharging and distributing steps.

8. A method as defined in claim 7, wherein said distributing step comprises distributing said paving materials closely adjacent said previously-paved segment.

9. A method as defined in claim 6, wherein substantially all of said paving materials are remixed during said feeding and distributing steps.

10. A method as defined in claim 6, further comprising working said paving materials into a mat after said distributing step using a screed mounted on said chassis.

* * * * *